United States Patent [19]

Chenest

[11] Patent Number: 4,817,844

[45] Date of Patent: Apr. 4, 1989

[54] ENDLESS INK RIBBON CASSETTE

[75] Inventor: Gerard Chenest, Saint Paer, France

[73] Assignee: Unisys Corporation, Blue Bell, Pa.

[21] Appl. No.: 45,483

[22] Filed: May 4, 1987

[30] Foreign Application Priority Data

May 14, 1986 [GB] United Kingdom ..... 8611731

[51] Int. Cl.[4] ..... B41J 32/02; B41J 33/16; B65H 20/02; B65H 20/28

[52] U.S. Cl. ..... 226/118; 226/181; 226/190; 400/196.1

[58] Field of Search ..... 226/181, 190, 194, 118; 242/197, 199; 400/194–196.1, 208, 235.1

[56] References Cited

U.S. PATENT DOCUMENTS

| | | | |
|---|---|---|---|
| Re. 31,117 | 1/1983 | Depew | 400/196.1 X |
| 4,582,439 | 4/1986 | La Spesa | 400/196.1 |
| 4,650,354 | 3/1987 | Morarka et al. | 400/196.1 |

OTHER PUBLICATIONS

IBM Technical Disclosure Bulletin, vol. 19, No. 8, Jan. 1977, p. 2978, Brumbaugh et al., Printer Ribbon Cassette.

*Primary Examiner*—Stuart S. Levy
*Assistant Examiner*—Lynn M. Sohacki
*Attorney, Agent, or Firm*—Mark T. Starr

[57] ABSTRACT

An endless ink ribbon cassette wherein a ribbon is drawn from a storage void for printing and reintroduced into the storage void after printing. The cassette includes a first driven induction wheel having first and second rim portions spaced apart on an axle. A second idler induction wheel, also mounted on an axle, is urged against the rim portions, the first and second induction wheels cooperating to draw the ribbon onto the first induction wheel and between the first and second induction wheels, whereby the ribbon is introduced into the storage void. A fixed insert maintained between the first and second rim portions prevents entry of the ribbon between the first and second rim portions.

8 Claims, 5 Drawing Sheets

ENDLESS INK RIBBON CASSETTE

BACKGROUND OF THE INVENTION

The present invention relates to an Endless Ink Ribbon Cassette wherein a ribbon is drawn from a storage void for printing and re-introduced into the storage void after printing. More particularly, the present invention relates to such an endless ink ribbon cassette wherein the ribbon is drawn into the void between first and second induction wheels.

Endless, reusable ink ribbons for computer peripheral printers, typewriters and similar printing devices are known to be provided in a cassette. The cassette typically comprises a pair of arms between which an exposed portion of the ink ribbon is suspended to be struck against paper or other printing material to achieve the printing process and to leave a visible record. As the ribbon is used for printing, so it is caused to move between the arms to present a fresh piece of ink ribbon to the striking device. The ribbon is moved by being drawn into one of the arms by means of a pair of opposed induction wheels inside the cassette between which the endless ink ribbon passes. The induction wheels pay out the ribbon into a storage void within the cassette. The void comprises parallel upper and lower walls separated by a distance equal to the width of the ribbon. The ribbon stacks itself in a serpentine manner against ribbon already within the void and the pack of ribbon in the void moves steadily away from the induction wheels towards an outlet point proximate to the other arm. Ribbon is drawn from the moving pack in the void into the other arm of the cassette and out into the exposed portion to be used in the printing process.

In order for the induction wheels to adequately drive the ribbon they must extend across the full ribbon width and thus occupy the entire height of the void within the cassette. Mounting of the wheels has been achieved by dividing the wheels in two so that they comprise first and second spaced rim portions with a support member passing between the rim portions to hold a central axle.

In the prior art, if the ribbon were to fold slightly into one or other of the spaces between the first and second rim portions on a wheel, the ribbon exiting from between the wheels is folded, has thereby a rigidity imparted by its folded geometric shape, and is not as pliable as an unfolded ribbon, thus preventing the ribbon from adopting the serpentine disposition within the void which in turn causes an irregular packing of the ribbon in the void. This can lead to jamming and discarding of the cassette before all of the ink on the ribbon has been used up.

The present invention comprises an endless ink ribbon cassette wherein a ribbon is drawn from a storage void for printing and reintroduced into the void after printing, the cassette including a first induction wheel having first and second rim portions spaced apart on an axle; a second induction wheel urged against the rim portions, said first and second induction wheels being co-operative to draw the ribbon onto said first induction wheel and between the first and second induction wheels to be introduced into the void; and a fixed insert maintained between the first and second rim portions and operative to prevent entry of the ribbon between the first and second rim portions.

Also in the prior art, the ribbon can fold to such an extent that it passes completely between the first and second spaced rim portions of the induction wheel and become trapped around the axle of the driven induction wheel, thereby causing instant jamming and loss of use of the cassette. In a preferred embodiment of the present invention, the insert is further operative to prevent entry of the ribbon between the insert and the axle.

In the prior art, the driven induction wheel can catch the ribbon as it is introduced into the void and maintain it against its surface, thus causing the ribbon to be wound round the outside of the wheel, again leading to instant jamming as the ribbon piles up between the wheel and the side wall of the cassette whereon the wheel is supported. In the preferred embodiment of the present invention, the insert is provided on an inner surface of a wall of the cassette and is operative to prevent entry of the ribbon when in the void between the induction wheel and the side wall.

In the preferred embodiment of the present invention, the insert is also operative to provide support for the axle of the first or driven induction wheel.

In the preferred embodiment of the present invention, the insert includes a circular portion having an outline including part of the circumference of a circle concentric with the axle of the induction wheel, where the circular portion has a diameter commensurate with the diameter of the first and second rim portions of the induction wheel. Also in the preferred embodiment, the portion of the circumference of the circle of the insert includes the point of contact between the first and second rim portions of the driven induction wheel and the second induction wheel.

A further feature of the preferred embodiment includes the portion of the circumference of a circle of the insert including the point of first contact of the endless ink ribbon with the first or driven induction wheel.

In the preferred embodiment of the present invention the portion of the circumference of a circle of the insert also extends around into the storage void area of the cassette. The commensurate radius of the portion of the circumference of a circle on the insert is preferred to be of the order of 1 mm. less than the radius of the first or driven induction wheel.

DESCRIPTION OF THE DRAWINGS

The present invention is further explained, by way of an example, by the following description taken in conjunction with the appended drawings, in which.

DESCRIPTION OF THE INVENTION

Figure 1:
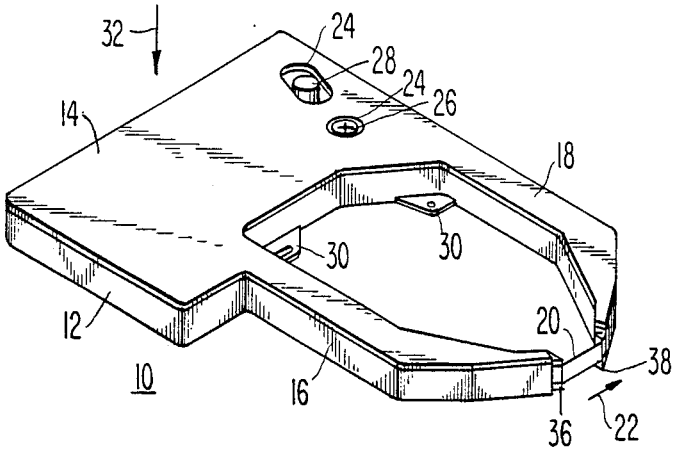
FIG. 1 shows an isometric projected view of a complete cassette according to the present invention.

FIG. 1 shows an endless ink ribbon cassette 10 comprising a base portion 12 and a lid 14. The cassette includes a ribbon feed arm 16 and a ribbon receiving arm 18, the arms 16,18 operative to support an exposed ribbon portion 20 between their tips for the exposed ribbon portion 20 to move as shown by the first arrow 22 during a printing operation wherein the exposed ribbon portion 20 is struck against paper by a printing device. The base portion 12 and the lid 14 are provided with slots 24 operative to support the axle 26 of a driven induction wheel and the axle 28 of an idler induction wheel. Mounting tabs 30 serve to provide positive location for the cassette 10 in the printing mechanism. The particular style of cassette shown in FIG. 1 is intended to be moved along a line of printing with a printhead. The present invention is not restricted to such a style of cassette and can, for example, comprise cassettes wherein the exposed ribbon portion 20 extends along the entire length of a row of printing along which a printhead or other printing device moves with the cassette 10 itself being stationary.

Figure 2:
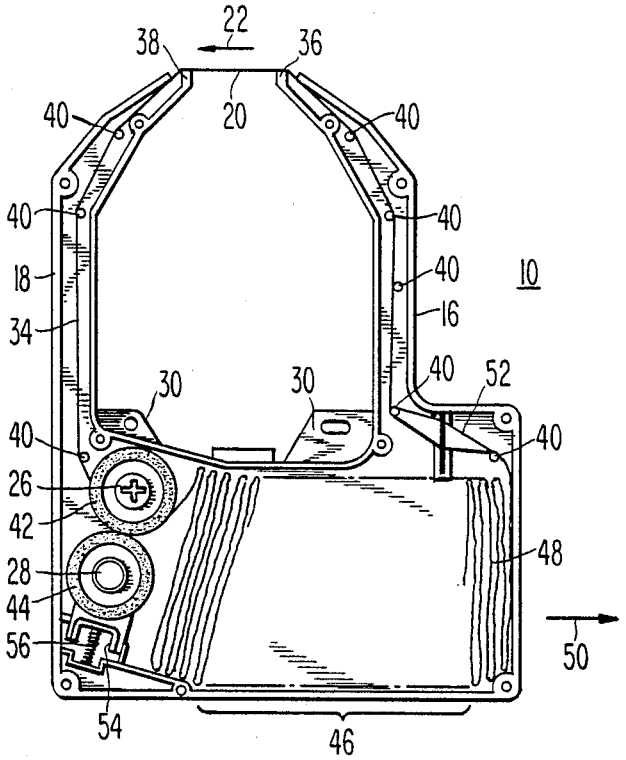
FIG. 2 shows a projected view of the cassette of FIG. 1 with the top cover removed.

FIG. 2 shows a projected view of the cassette 10 of FIG. 1 with the lid 14 removed looking in the direction of the second arrow 32.

An endless loop of ink ribbon 34 passes between the respective tips 36,38 of the ribbon feed arm 16 and the ribbon receiving arm 18 over pegs 40 which guide it within the cassette between a first induction wheel 42 and a second induction wheel 44 into a storage void 46 in the cassette 10. The ribbon 34 in the storage void 46 forms a pack 48 consisting of layers of serpentine loops into which the ribbon introduced into the void 46 between the first 42 and second 44 induction wheels automatically pays itself. The pack 48 of ribbon 34 moves as indicated by a third arrow 50 away from the induction wheels 42,44 towards a payout point proximate to the ribbon feed arm 16 including a fold-over arm 52 which imparts a twist and some frictional drag to the ribbon 34 such that the ribbon 34, which can be provided in the form of a mobius strip, thereby has both surfaces presented to the paper in the exposed ribbon portion 20 on alternate passages through the cassette. The pegs 40 also serve to impart friction to the ribbon 34 within the ribbon feed arm 16 and the combined friction of the fold-over arm 52 and the pegs 40 in the ribbon feed arm 16 combine with the traction on the ribbon 34 of the first and second induction wheels 42,44 to maintain the exposed ribbon portion 20 taught between the tips 36,38 of the respective arms 16,18.

The first induction wheel 42 is provided with traction coupling means in its axle 26 for the first induction wheel 42 to receive driving torque from a motor (not shown) or other mechanism external to the cassette 10. The second induction wheel 44 is an idler wheel driven by mutual frictional engagement between itself, the ribbon 34 trapped between it and the first induction wheel 42, and the first induction wheel 42 itself. A mount 54 holding the second induction wheel 44 is urged by a spring 56 to push the second induction wheel 44 against the first induction wheel 42 to provide a predetermined amount of friction coupling between the first and second induction wheels 42,44 and the ribbon 34. The axle 26 of the first or driven induction wheel 42 can include a slotted opening as illustrated or can comprise any other form of frictional or gear coupling required to impart rotation to the first induction wheel 42.

As well as guiding the endless ink ribbon 34 around the cassette 10, the pegs 40 also serve as a means of holding the lid 14 of the cassette 10 onto the base 12 by provision of apertures (not shown) in the lid 14 for engaging the pegs 40.

Figure 3:
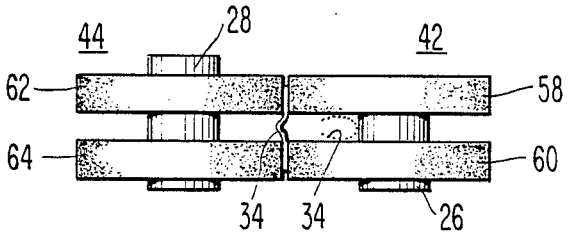
Fig. 3 PRIOR ART
FIG. 3 illustrates the opposed induction wheels according to the prior art and illustrates problems associated therewith.

FIG. 3 shows a side elevation view of a prior art arrangement of the first and second induction wheels 42,44. The same induction wheels 42,44 are used in the present invention with the addition of components not shown in FIG. 3.

The first or driven induction wheel 42 comprises a first rim portion 58 spaced apart from a second rim portion 60 on the axle 26. Similarly, the second induction wheel 44 comprises a first rim portion 62 spaced apart from a second rim portion 64 on the axle 28. The first and second induction wheels 42,44 are sufficiently tall to fill the gap between the lid 14 and the floor of the base portion 12 of the cassette 10.

The first rim portion 58 of the first induction wheel 42 presses against the first rim portion 62 of the second induction wheel 44 and the second rim portion 60 of the first induction wheel 42 presses against the second rim portion 64 of the second induction wheel 44.

In the preferred embodiment of the present invention, the rim portions 58,60,62,64 each preferably comprise a hard moulded core with a pliable rubber rim of smooth surface. It is to be appreciated that in the present invention the rim portions 58,60,62,64 may otherwise be constructed being all of elastic material, or all of hard material and having a surface other than smooth.

In passing between the opposed first and second induction wheels 42,44, the ribbon 34 can become partially folded as shown in solid line in FIG. 3. A more extreme condition of folding of the ribbon 34 is shown in dotted line in FIG. 3 where the ribbon has folded to such an extent that it has passed completely between the first and second rim portions 58,60 of the first induction wheel 42 and has come up against the axle 26.

Figure 4:
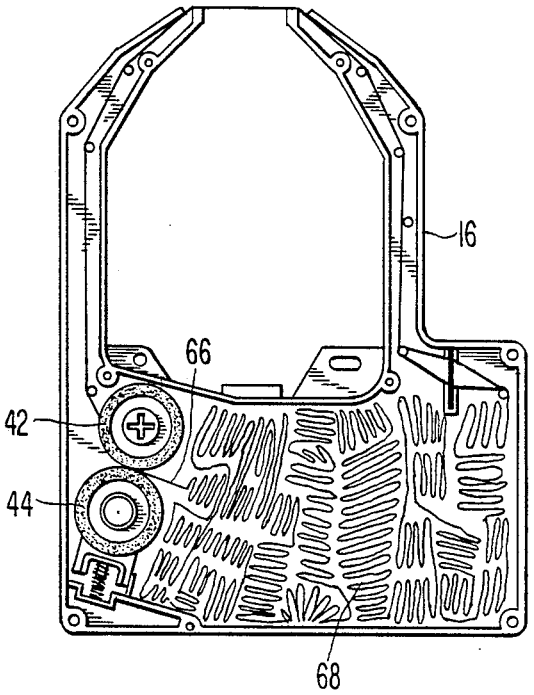
Fig. 4 PRIOR ART
FIG. 4 illustrates bad packing of the endless ink ribbon in the storage void encountered in the prior art.

FIG. 4 shows a projected view of a prior art cassette with its lid removed, where partial folding of the ribbon 34 as shown in solid line in FIG. 3 has occurred.

The partially folded ribbon 34 retains considerable geometric strength after it exits from between the first and second induction wheels 42,44. A rigid section 66 of ribbon 34 is thus created which is not pliable and does not fold in the loose serpentine pattern shown in FIG. 2. Instead, a jumbled pack 68 of stored ribbon 34 is created comprising a plurality of independent short serpentine packs of ribbon which collapse, tumble and break over one another. There is thereby created a great risk of the jumbled pack 68 not being capable of properly moving within the void away from the first and second induction wheels 42,44 towards the ribbon feed arm 16. Statistically the operational life of a cassette with this problem is reduced in that the pack 68 has a probability of jamming before the useful life of the ink on the ribbon 34 has reached its end.

Figure 5:
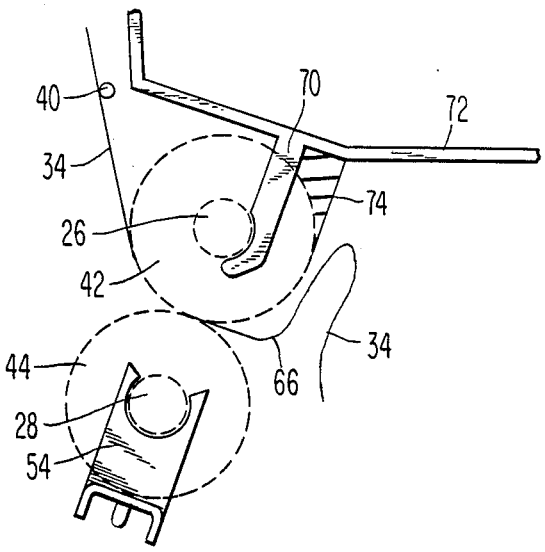
Fig. 5 PRIOR ART
FIG. 5 illustrates a prior art cassette induction wheel mounting system and shows the manner in which ribbon introduced into the storage void is rendered rigid.

FIG. 5 shows in greater detail the manner of mounting and usage of the first and second induction wheels 42,44 in the prior art. In FIG. 5, the first and second induction wheels 42,44 are shown in dotted outline as are their respective axles 26,28.

A spur 70 mounted on a portion 72 of a side wall of the base 12 of the cassette 10 loosely engages the axle 26 of the first induction wheel 42, passing between the first and second rim portions 58,60 thereof. The mount 54 otherwise described with reference to FIG. 2 is a fork shaped device passing between the first and second rim portions 62,64 of the second induction wheel 44 to engage its axle 28. FIG. 5 illustrates how the ribbon 34 exiting from between the first and second induction wheels 42,44 has the rigid section 66 created as the ribbon 34 is paid into the void 46.

A space 74 (shown in hatch line) is created between the first induction wheel 42 and the portion 72 of side wall proximate to which the first induction wheel 42 is mounted. If the ribbon 34, having been introduced into the void 46, remains in train or once again becomes entrained with the periphery of the first induction wheel 42, it can be pulled round into the space 74 to become trapped between the first induction wheel 42 and the portion 72 of side wall. Having thus become trapped, the ribbon 34 can be folded and otherwise entangled both with the spur 70 and with the first induction wheel 42 in such a manner that either the first induction wheel 42 is jammed and brought to a stop or the ribbon 34 is wound for one or more extra turns around the periphery of the first induction wheel 42, thereby causing all space between the first induction wheel 42 and the portion 72 of the side wall to be filled and the cassette 10 to be jammed. In such an action, ribbon 34 is drawn from the void 46 onto the first induction wheel 42 in the wrong direction. Further, such folding and distortion of the ribbon 34 can cause the ribbon to become jammed between the lid 14 or floor of the base section 12 of the cassette 10 and the top or bottom surfaces of the first induction wheel 42, thereby causing further jamming. The examples here given of ways in which jamming can follow upon introduction of ribbon 34 into the space 74 between the first induction wheel 42 and the portion 72 of side wall proximate to the first induction wheel is by no means exhaustive.

Figure 6:
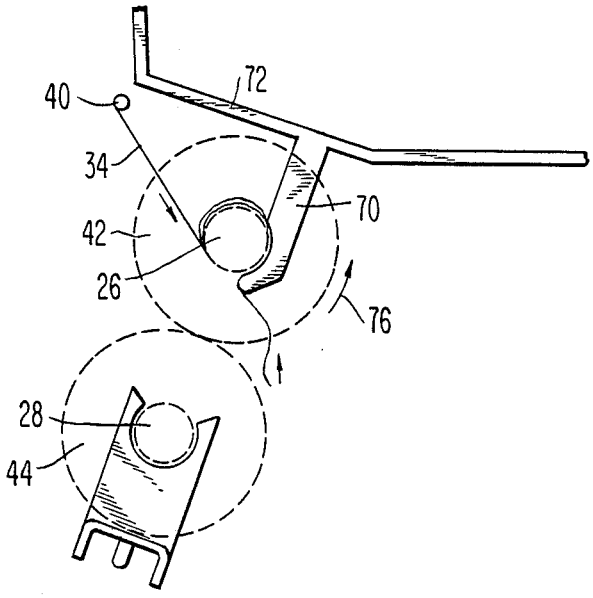
Fig. 6 PRIOR ART
FIG. 6 shows the prior art induction wheel mounting system for the cassette of FIG. 5 and illustrates the problem of ribbon collapsing into the void between the first and second spaced rim portions.

FIG. 6 shows the arrangement of FIG. 5, this time with the ink ribbon 34 in the totally folded and collapsed position shown by dotted line 34 in FIG. 3. In this situation, either all traction on the ribbon 34 ceases or the ribbon 34 is drawn onto the axle 26 of the first induction wheel 42 to become entangled between the axle 26 and the spur 70, thereby causing the first induction wheel 42 to jam and rendering the cassette 10 useless. If all traction is lost the cassette 10 is once again rendered useless. In such case, the portion of the ribbon 34 in the storage void 46 can be drawn from the storage void 46 in the wrong direction. The inner surfaces of the rim portions 58,60 of the first induction wheel 42 can also engage the ribbon 34 and carry it around as illustrated by a fourth arrow 76 once again to become entangled with the spur 70.

Figure 7:
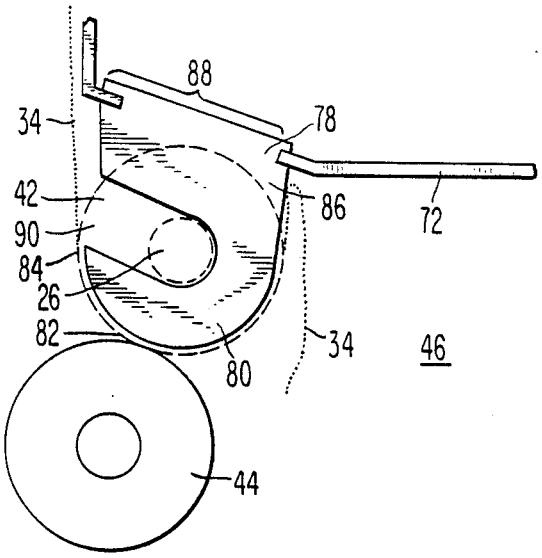
FIG. 7 is a plan view of the induction wheel mounting system according to the present invention.

FIG. 7 shows the manner of mounting of the first induction wheel 42 according to the present invention. In FIG. 7, the first induction wheel 42 is shown in broken outline as is its axle 26.

In FIG. 7, the elements are substantially those shown in FIGS. 3,4,5 and 6, with the difference that the spur 70 has been replaced by a supporting insert 78. As before, the insert 78 passes between the first and second rim portions 58,60 of the first induction wheel 42 to engage the axle 26. The supporting insert 78 comprises a portion 80 having as its outline part of the circumference of a circle centered upon the center of the axle 26 and having a radius almost equal to the radius of the first and second rim portions 58,60 of the first induction wheel 42. In the present example of the invention, the portion 80 of the insert 78 having as its outline part of the circumference of a circle has a radius 1 mm. less than the radius of the first induction wheel 42 when the last mentioned wheel is in an uncompressed state. Where the first induction wheel 42 presses against the second induction wheel 44, mutual compression causes the distance below the edge of the first induction wheel 42 of the insert 78 to be between zero and 1 mm. In the present invention, the insert 78 always has a radius which is equal to or less than the radius of the first induction wheel 42 even where it is pressed against the second induction wheel 44. Thus, where induction wheels 42 and 44 are not mutually compressed, the portion 80 of the insert 78 having as its outline part of the circumference of a circle thus always lies just inside the first and second rim portions 58,60 of the first induction wheel 42 in the gap therebetween. The radius of that portion 80 of the insert 78 having as its outline part of the circumference of a circle is substantially the same as, but marginally less than the radius of the first induction wheel 42.

The portion 80 of the insert 78 having as its outline part of the circumference of a circle firstly includes the point 82 where the first and second induction wheels 42,44 are pressed together, thereby preventing collapse of the ribbon 34 between the first and second rim portions 58,60 of the first induction wheel 42 (as illustrated in FIG. 3 of the prior art). The portion 80 of the insert 78 having as its outline part of the circumference of a circle also extends to the same angular position as that of the point 84 whereat the taut ribbon 34 returning from the receiving arm 18 first meets the circumference of the first induction wheel 42 in a tangential contact. Because of the very small difference, approximately 1 mm. between the respective radii of induction wheel 42 and portion 80 of insert 78 at ribbon tangential point 84, the portion 80 the insert in this instance again prevents any significant or possibly detrimental collapse of the ribbon 34 into the space between the first and second rim portions 58,60 of the first induction wheel 42.

The insert 78 continues in its portion 80 having as its outline part of the circumference of a circle round into the void 46 and smoothly expands into a blocking section (of non circular outline) which fills the space between the first induction wheel 42 and the wall 72 whereon the supporting insert 78 is held. As shown in FIG. 7, the portion of ribbon 34 in the void 46, even if entrained upon the outer surface of the first induction wheel 42, is prevented from entering the gap between the side wall 72 and the first induction wheel 42, thereby preventing it from becoming trapped therebetween. In this manner, jamming of the first induction wheel 42 by unwanted fouling or wrapping of the ribbon 34 is avoided.

The insert 78 is mounted in a gap 88 in the wall 72. The insert 78 itself comprises a passage 90 which accepts the axle 26 and assists in its location within the cassette 10. The axle 26 is first placed into the passage 90 with the insert 78 between the first and second rim portions 58,60 of the first induction wheel 42 with the insert 78 and the first induction wheel 42 outside the cassette 10. The insert 78 complete with the first induction wheel 42 is then placed in its position in the gap 88 in the side wall 72 of the cassette 10 and the lid 14 of the cassette 10 placed there-over to hold the insert 78 in place. The insert 78 can comprise its own packing piece (not shown) to fill the gap between its planar portion (80,86) and the engagement of the lid 14 with the gap 88 in the wall 72. Alternatively the lid 14 can comprise a depending portion (again not shown) operative to engage the insert 78 and close any remaining space in the gap 88 in the side wall 72 of the cassette 10.

The manner of provision of the insert 78 above described is not restrictive. Where no post 40 is present which may prevent insertion of the axle 26 into the passage 90, the insert 78 may be made an internal part of the side wall 72 and need not be a separate, removable item. Similarly, the passage 90, while shown in this example as being proximate to the point of first tangential contact 84 of the ribbon 34 with the first induction wheel 42, may in fact be placed at other angles than that shown. The only requirement in the present invention is that the portion 80 of the insert 78 having as its outline part of the circumference of a circle meets the criteria hereinbefore described.

Figure 8:
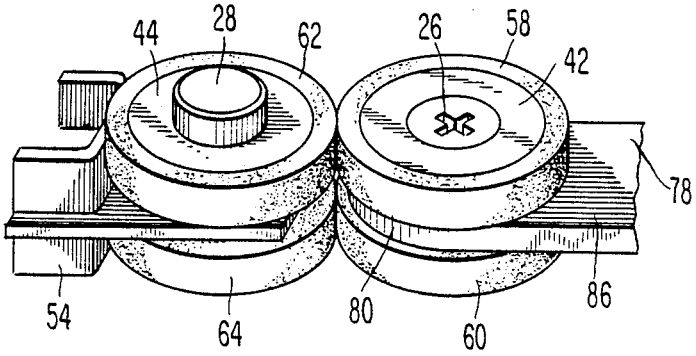
FIG. 8 is an isometric projected view of the induction wheels of FIG. 7.

FIG. 8 shows an isometric projected view of the first and second induction wheels 42,44 of FIG. 7 according to the present invention. In particular, FIG. 8 illustrates how that portion 80 of the insert 78 having as its outline part of the circumference of a circle lies just beneath the outer edge of the first and second rim portions 58,60 of the first induction wheel 42 and how the insert 78, lying between the first and second rim portions 58,60 of the first induction wheel 42, is provided with its blocking section 86 as a smooth continuation of outline from that portion 80 of the insert 78 having as its outline part of the circumference of a circle.

Figure 9:
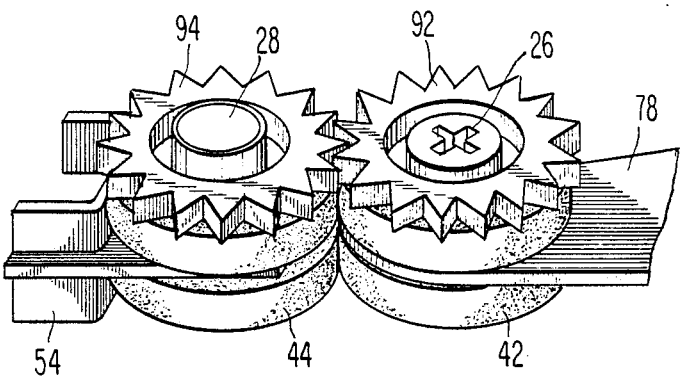
FIG. 9 shows an alternative embodiment of the induction wheels of FIG. 8 wherein mutually enmeshed gears are provided.

FIG. 9 shows an isometric projected view of an alternative embodiment of the present invention. The first and second induction wheels 42,44 and all other elements are as shown in FIGS. 7 and 8 except that the first induction wheel 42 is provided with a first gear wheel 92 and the second induction wheel 44 is provided with a second gear wheel 94. The first and second gear wheels 92,94 are each concentric with the respective axles 26,28 of the first and second induction wheels 42,44 and have teeth adapted for the first and second gear wheels 92,94 to engage one another when the first and second induction wheels 42,44 are urged against each other for the first gear wheel 92, driven by external motive means to cause turning of the second gear wheel 94 and thus to rotate the second induction wheel 44. The first gear wheel 92 may be driven by an external gear wheel (not shown) inserted into the cassette via a further aperture in the casing (12 or 14) of the cassette 10. The first and second gear wheels 92,94 provide that, where mutual friction between the first and second induction wheels and/or between the first and second induction wheels and the ribbon 34 is not or cannot be used for the first induction wheel (the driven induction wheel) 42 to turn the second induction wheel (the idler induction wheel) 44, the first induction wheel 42 and the second induction wheel 44 can nonetheless be driven together. The radii and tooth structure of the first and second gear wheels 92,94 can also be chosen such that the second induction wheel is urged to travel at a different speed of rotation from the first induction wheel. Surface friction between the first and second induction wheels 42,44 ensures that the same speed of rotation must be enjoyed, but the elastic tension created can ensure that the ribbon 34 exits from between the first and second induction wheels 42,44 with a preferred bias towards whichever one of the first and second induction wheels 42,44 is urged to travel at a lower rotational speed.

Figure 10:
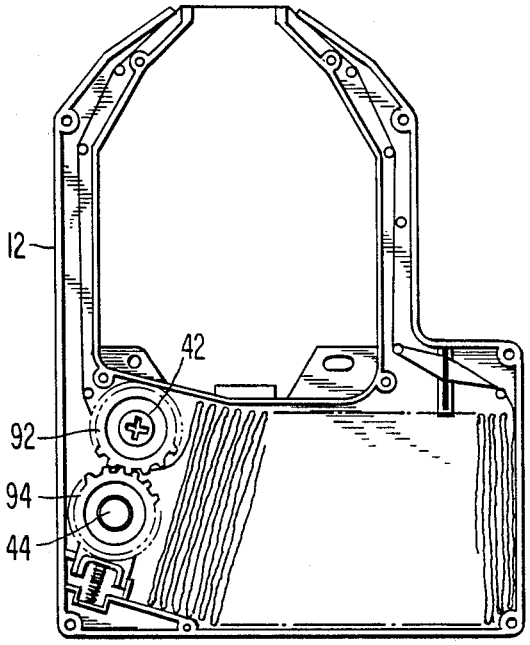
FIG. 10 shows a complete cassette assembled using the geared induction wheels of FIG. 9.

FIG. 10 is a projected plan view of a cassette according to the present invention and incorporating the geared induction wheels 42,44 illustrated in FIG. 9. The height of the first and second induction wheels 42,44 is slightly reduced to accommodate the thickness of the first and second gear wheels 92,94 such that the combination of the first and second induction wheels 42,44 and their respective gear wheels 92,94 just fills the gap between the lid 14 and the floor of the base portion 12 of the cassette 10.

While the present invention has been described with reference to use in an endless ink ribbon cartridge for creating a visible record, it is to be appreciated that a similar cartridge may be used to deposit any other kind of record upon sheet material. In particular the invention may be used to deposit magnetic particles onto paper, or substances not normally visible to the naked eye. The endless ink ribbon has been herein-before described as a mobius strip having a twist therein. It is to be appreciated that an ink ribbon without such a twist can also be employed in the present invention. It is also to be appreciated that the arms 16,18 are not an essential feature in the present invention and that a simple cassette wherein the exposed portion 20 of the ribbon 34 is presented externally to the storage void 46 in any other way and in any other position can also employ the present invention.

I claim:

1. An endless ink ribbon cassette wherein a ribbon is drawn from a storage void and reintroduced into said void, said cassette comprising:

a first induction wheel including first and second rim portions spaced apart on an axle; a second induction wheel urged against said rim portions, said first and second induction wheels being cooperative to draw said ribbon onto said first induction wheel and between said first and second induction wheels to be introduced into said void; and unitary fixed insert means, said cassette including an inner wall for maintaining said insert means between said first and second rim portions, said insert means comprising a first portion and a second portion, said first portion having as its outline, part of the circumference of a circle concentric with said axle of said first induction wheel, the periphery of said first portion of said insert extending at least from the angular position where said ribbon first contacts said first induction wheel to the point at which said second induction wheel is urged against said rim portion of said first induction wheel, thereby preventing entry of said ribbon between said first and second rim portions, said second portion of said insert means being continuous with said first portion of said insert means, the periphery of said second portion of said insert means including spaced-apart sides extending from opposite sides of said outline of said first portion of said insert means, the one of said sides furthest from the position where said ribbon first contacts said first induction wheel extending tangentially from said outline of said first portion of said insert means, said spaced-apart sides terminating in a common transverse side engaging said inner wall of said cassette, said second portion of said insert means filling the space between said first induction wheel and said inner wall, thereby stripping said ribbon from said last mentioned wheel, while negating the entrapment of said ribbon within said space.

2. A cassette according to claim 1 wherein said insert means further includes support means for supporting said axle, said support means comprising a passage having an opening in the periphery of said insert means in proximity to, and upstream from the point at which said ribbon first contacts said first induction wheel, the periphery of said insert means extends downstream from said last mentioned point to said inner wall and is continuous.

3. A cassette according to claim 3 wherein said insert means is removably mounted on said inner wall of said cassette.

4. A cassette according to claim 1 wherein said first portion of said insert means has a radius which is substantially the same as, but marginally less than the radius of said first and second rim portions wherever the last mentioned portions are not urged against by said second induction wheel.

5. A ribbon cassette as defined in claim 1 further comprising:

a base portion;

a lid coupled to said base portion;

said axle of said first induction wheel being journaled between said base portion and said lid;

said second induction wheel being coupled to an axle, said axle of said second induction wheel being journaled between said base portion and said lid;

said endless ink ribbon being positioned between said first and second induction wheels.

6. The cassette according to claim 5 further including urging means, coupled to said base portion, for urging said second induction wheel toward said rim portions.

7. A cassette as defined in claim 4 wherein at least the outer surfaces of said first and second rim portions of said first induction wheel are formed of flexible material, said material being compressed at the point where said second induction wheel is urged against said rim portions such that the radius of said rim portions approaches equality with the radius of said first portion of said insert means.

8. A cassette as defined in claim 7 wherein said second induction wheel includes first and second rim portions spaced apart on said axle associated therewith.

* * * * *